United States Patent [19]

Neufeld

[11] Patent Number: 4,932,355

[45] Date of Patent: Jun. 12, 1990

[54] METHOD FOR REMOVING A DEVELOPER MIX FROM A DEVELOPING STATION

[75] Inventor: Manfred Neufeld, Baierbrunn, Fed. Rep. of Germany

[73] Assignee: Siemens Aktiengesellschaft, Berlin and Munich, Fed. Rep. of Germany

[21] Appl. No.: 912,042

[22] Filed: Sep. 26, 1986

[30] Foreign Application Priority Data

Oct. 9, 1985 [DE] Fed. Rep. of Germany ..... 3536080

[51] Int. Cl.[5] ..... G03G 15/08

[52] U.S. Cl. ..... 118/652; 355/246

[58] Field of Search ..... 118/652; 355/15; 427/125

[56] References Cited

U.S. PATENT DOCUMENTS

| | | | |
|---|---|---|---|
| 3,685,485 | 8/1972 | Kutsuwada et al. | 355/15 |
| 3,764,208 | 10/1973 | Takahashi et al. | 355/3 |
| 3,784,297 | 1/1974 | Ito et al. | 355/3 |
| 3,930,466 | 1/1976 | Stover | 118/637 |
| 4,058,086 | 11/1977 | Jugle et al. | 355/15 |
| 4,205,911 | 6/1980 | Dole | 355/15 |
| 4,439,034 | 3/1984 | Daniels | 355/3 DD |
| 4,451,133 | 5/1984 | Kopp et al. | 355/3 |
| 4,459,012 | 7/1948 | Allen et al. | 355/15 |

FOREIGN PATENT DOCUMENTS

| | | | |
|---|---|---|---|
| 87577 | 5/1983 | Japan | 355/15 |
| 201374 | 10/1985 | Japan | 355/15 |

*Primary Examiner*—Shrive Beck
*Assistant Examiner*—Alain Bashore
*Attorney, Agent, or Firm*—Hill, Van Santen, Steadman & Simpson

[57] ABSTRACT

An apparatus for removing a developer mix containing a magnetic component from a developing station of a non-mechanical printer or copier device. The developing station, at its lower portion, includes a channel-like discharge opening which extends over the full width of the developing station. A magnetic closing device is provided in the vicinity of the discharge opening, and functioning such that in its energized condition, its magnetic field acts on the developer mix to form a plug of developer mix in the region of the discharge opening which closes off the discharge opening. In the de-energized condition, the magnetic closing device releases the discharge opening whereupon the developing station is emptied by the action of a succeeding suction device such as a blower.

3 Claims, 2 Drawing Sheets

METHOD FOR REMOVING A DEVELOPER MIX FROM A DEVELOPING STATION

BACKGROUND OF THE INVENTION 1. Field of the Invention

The present invention is in the field of non-mechanical printer or copying devices and is particularly concerned with a discharge device for efficiently and rapidly removing a developer mix from a developing station.

2. Description of the Prior Art

In copying device technology, and in non-mechanical fast data printers which use the principles of electrophotography, charge images are generated on a charge image carrier such as a photoconductive drum and are subsequently inked with a black powder (toner) in a developing station. With the use of a photoconductive drum, the toner images are subsequently transferred onto normal paper and are fixed there. As a rule, a two-component developer is employed for developing, being composed of ferromagnetic carrier particles and of toner particles. The developer mix is normally conducted past the charge image carrier by means of a magnetic brush arrangement, the toner particles adhering to the charge image due to electrostatic forces. Such a developing station is shown, for example, in German AS 21 66 667.

Since the developer mix loses its tribo-electric properties with the passage of time, it must be replaced with a new developer mix at the end of its service life. The replacement of the developer mix must be capable of being carried out simply.

In U.S. Pat. No. 3,764,208 there is a disclosure of a device for removing developer mix from a developer station of an electrophotographic device. The device includes a developer roll and a mixing screw at the bottom of which there is a discharge opening comprising a pipe for the connection of a receptacle which accepts the developer mix from the floor of the developing station. To remove the developer mix, the rotational sense of the mixing screw of the developer drum is reversed in order to transport the developer mix into the discharge opening.

In such devices, there is the risk that the mix can unintentionally flow out in the region of the discharge pipe. There is also a risk of contaminating the surroundings when connecting and removing the receptacle. A complete emptying is not possible since the screw and the screw channel associated therewith must also have a defined distance from one another. The overall emptying process also lasts a relatively long time. As experience has shown, the toner may become caked and become lodged at the screws.

SUMMARY OF THE INVENTION

The present invention provides a device of the type described in which the developer mix can be removed from the developer station completely, quickly, and without risk of contamination to the environment.

In the present invention there is provided a non-mechanical printer or copier device having a developing station containing a developer mix which includes magnetic components. Means are provided at the base of the device which define a channel-like discharge opening extending over the width of the developing station. A magnetic closing device is positioned in close proximity to the discharge opening, the magnetic closing device being positioned to form a plug of developer mix in the discharge opening when the magnetic closing device is actuated and permits discharge of the developer mix through the discharge opening when deactivated. A suction device is provided downstream of the discharge opening for drawing developer mix through the discharge opening.

The magnetic closing device may comprise a magnetic strip which extends the full width of the discharge opening and may be pivotally mounted to the housing so that the magnetic strip is moved toward and away from the discharge opening. The magnetic strip may include electromagnetic devices as well as permanent magnets.

The suction device used to empty the developing station may include an air collector which extends over the entire width of the discharge opening and a succeeding blower which is connected to the air collector. A cyclone filter is advantageously employed for filtering the air-developer mix after it leaves the discharge opening. There may also be a filter for fines preceding the blower.

For emptying the developing station, the magnetic strip, when including permanent magnets, is pivoted away in a simple fashion or, in the case of an electromagnet, it is deactivated by shutting the power to the electromagnetic coils. The discharge opening thereby is uncovered and a suction device supplies a reduced pressure at the discharge opening so that the developer mix can be extracted from the developing station quickly and reliably.

In order to secure a uniform extraction, the discharge opening is preferably followed by a cylindrical air collector in which the extracted developer mix is swirled and which essentially serves the purpose of maintaining a uniform pressure profile along the discharge opening. A fast, clean, reliable emptying of the developer mix out of the developing station thus becomes possible.

As a result of the closed discharge system, there is no risk of contamination of the environment. This is also true when there is unintentional actuation of the magnetic closing device. The emptying occurs extraordinarily fast and reliably. By employing a magnetic closing device, mechanically movable parts such as slides and valves are not exposed to the abrasive developer mix. The overall mechanism is thereby significantly more reliable operationally and is wear resistant. With an activated magnetic closing device, a reduced pressure can be constantly generated at the discharge opening by means of the suction means without having the developer mix discharge.

A collection device for containing residual toner already present in an electrophotographic printer device can also be employed in the mechanism of the present invention in an advantageous way. No additional drive is necessary for the removal of the developer mix since the removal occurs essentially only on the basis of reduced pressure.

To accomplish change of color or repair work, the mix which is still usable is suctioned into a container situated in the collecting container and can then be refilled therefrom into the developer station for a new mix.

The overall mechanism can be integrated in a simple manner in a developing station without significant increase in cost and without occupying a great deal of space. When using the emptying mechanism and an electrophotographic printer device in which different colors are printed, a change of color can be very quickly carried out.

The present invention also provides a method and apparatus for replenishing a developer mix on a continuous basis, using magnetic closure elements which may be automatically actuated.

BRIEF DESCRIPTION OF THE DRAWINGS

A preferred embodiment of the invention is shown in the drawings and will be set forth in greater detail below by way of example. In the drawings.

DESCRIPTION OF THE PREFERRED EMBODIMENTS

Figure 1:
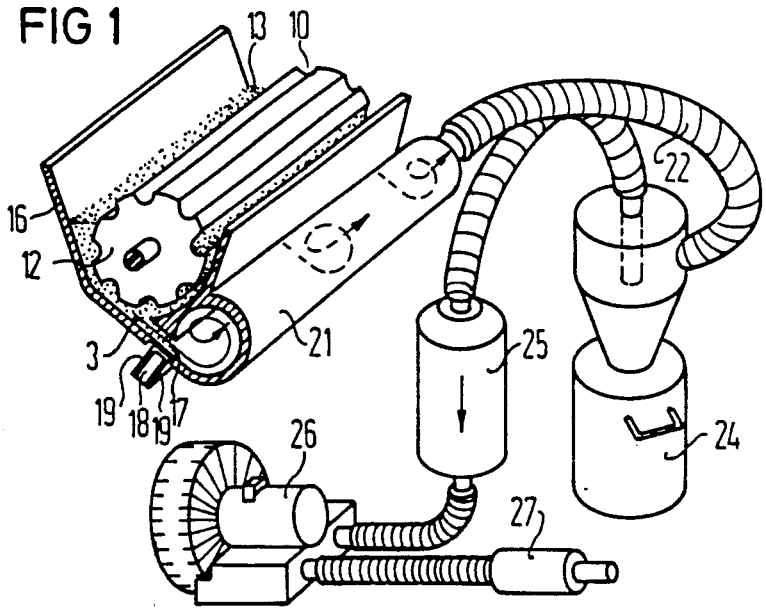
FIG. 1 is a somewhat schematic illustration of a device for removing a developer mix from a developing station of an electrophotographic printer device.

In a printer device using the principle of electrophotography, there may be provided a developing station 10 arranged adjacent to a charge image carrier 11 consisting, for example, of a photoconductive drum. The developing station 10 may contain a paddle wheel 12 for blending a two-component developer mix of ferromagnetic carrier particles and the actual toner particles which ink the charge carrier 11. For inking the photoconductive drum 11, the blended developer mix 13 is brought into the vicinity of the photoconductive drum 11 by means of a magnetic drum arrangement comprising a rotating hollow cylinder 14 with magnets rigidly secured thereon. The overall mixing and conveying devices for the toner are motor driven in a known way, and are not shown in detail in the drawings.

Figure 2:
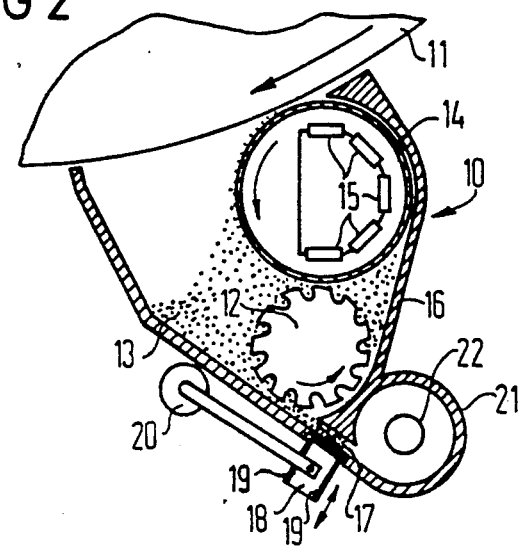
FIG. 2 is a cross-sectional view of a portion of the mechanism shown in FIG. 1.

The developing station is composed of a trough-like housing 16 composed, for example, of an impact-resistant plastic which extends along the photoconductive drum in the axial direction in accordance with the width of the photoconductive drum 11. A discharge opening in the form of a flat channel 17 is situated at the floor of the housing, the flat channel 17, for example, including an inside clearance of about 3 mm. A permanent magnet strip 18 extending over the length of the discharge opening is arranged in the vicinity of this discharge opening which has the form of a flat channel. The magnetic strip may be composed of a barium ferrite magnet which comprises pole pieces at both sides and, for example, has an energy product of about 20 $kJ/m^3$. The permanent magnet strip 18 can be pivoted toward and away from the discharge opening by means of an electromotive device such as a motor 20 as best illustrated in FIG. 2.

The flat channel discharge opening 17 communicates with a cylindrical air collector 21. The air collector 21 is composed of a cylindrical pipe which extends along the discharge opening, i.e., the flat channel 17, over the full width of the developing station. Instead of a cylindrical air collector, a conical air collector can also be employed with its larger diameter being situated in proximity to the air exit opening 22. The flow conditions are thus favorably modified and the air collector can be manufactured by means of an injection molding process in a simple manner. The air collector 21 is in communication with a cyclone filter 23 by means of a flexible conduit 22. The cyclone filter 23 is releasably connected to the collecting container 24 for the developer mix. The cyclone filter 23 is followed by a fine particle filter 25 which, in turn, is in communication with a blower 26 generating a reduced pressure at its inlet side. A noise damping means 27 is located at the air exit region of the blower 26.

The overall device operates in the following way. In normal operation of the electrophotographic printer device, the developing station is filled with developer mix and, as shown in FIGS. 1 and 2, the permanent magnet strip 18 is pivoted against the flat channel discharge opening 17. As a result of the magnetic field being generated in the region of the discharge opening 17, which opening has an average height of about 3 mm, the permanent magnet strip 18 generates a plug of ferromagnetic carrier particles which prevents an emergence of the developer mix from the discharge channel.

A reduced pressure is generated by the constantly operating blower in the air collector 21. The magnetic force of the permanent magnet strip, however, is such that the developer mix cannot discharge through the flat channel discharge 17. Since, in electrophotographic printers, a reduced pressure must constantly be generated in the print mode for removing the toner adhering to the photoconductive drum in the cleaning device and this occurs likewise by means of the blower 26 in a manner not shown in detail, the air collector 21 can be at a reduced pressure during overall operation of the electrophotographic printer means. However, it is also possible to provide separate blowers for the cleaning station and for the mechanism for removing the developer mix.

When the developer mix is to be removed from the developing station 10 with the described device, the permanent magnet strip 18 is pivoted away out of the region of the flat channel discharge 17 by the operation of the motor device 20. The flat channel strip 17 which serves as a discharge opening for the developer mix is thus released and the developer mix can flow along a helical path into the cylindrical air collector 21 as a result of the presence of the reduced pressure amounting to about 100 mm of water, the air collector 21 typically having an approximate diameter of 45 mm. After leaving the air collector by means of the tubular conduit 22, the swirled developer mix 13 flows into the cyclone filter 23 in which it settles due to the radial flow of the air-developer mix in the cyclone filter. The developer mix falls from the cyclone filter into the collecting container 24. Only small residues of the developer mix penetrate into the fine filter 25 which removes this final residue of developer mix.

In the examples set forth above, a permanent magnet strip of barium ferrite having pole faces at both sides is employed. Instead of this permanent magnet strip 18, however, it is also possible to provide an electromagnet which is activated as needed. The electromagnet can be composed of individual magnetic elements which is also true of the structure of the permanent magnet strip.

Figure 3:
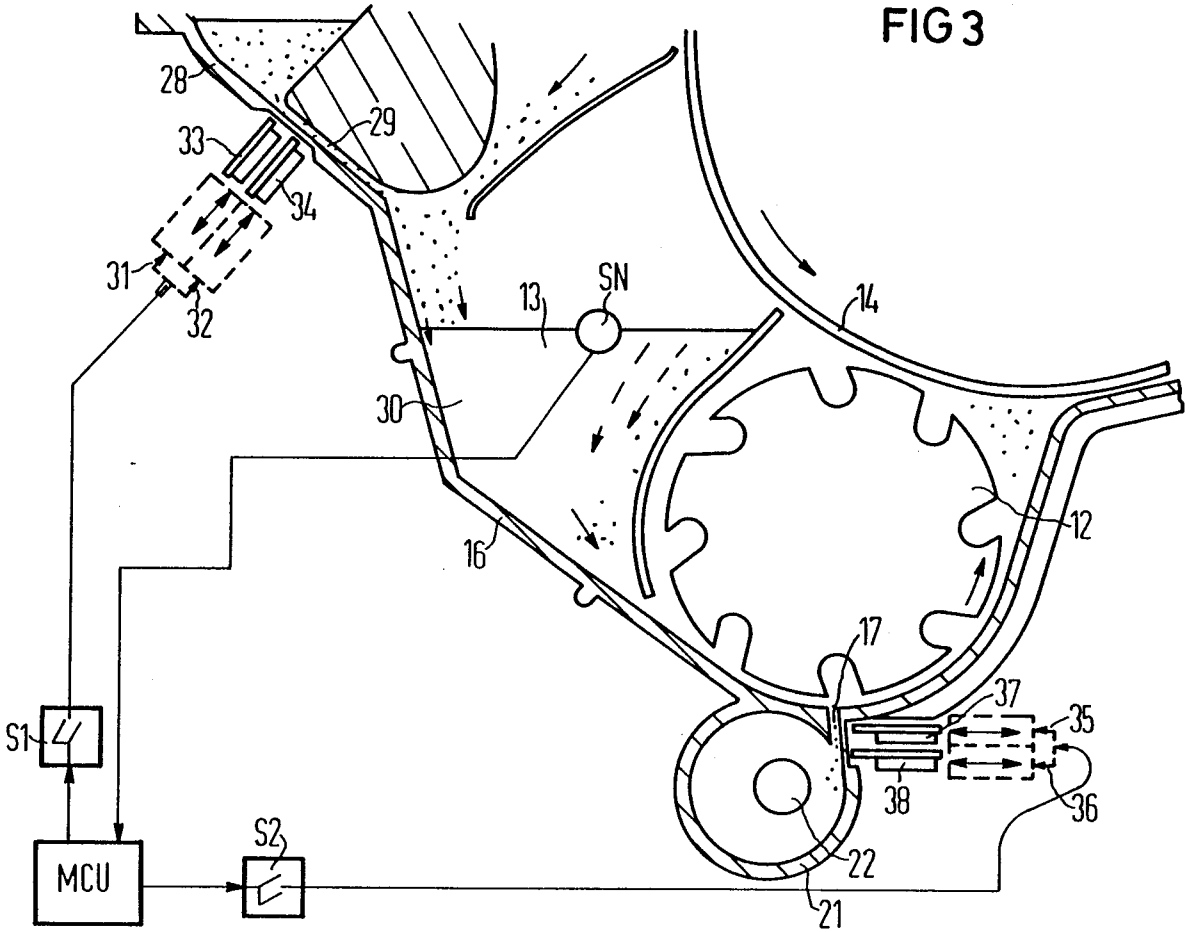
FIG. 3 is a cross-sectional view of a device for continuously replenishing a developer mix at a developer station.

In the form of the invention shown in FIG. 3, there is illustrated a printer operating on the principle of electrophotography. The structure shown in FIG. 3 is used to continuously replenish the developer mix in a continuous manner. As shown in FIG. 3, a developer mix 13 is supplied from a reservoir 28 to a mix container 30 of the developing station by means of a feeder channel 29. The feeder channel 29 is equipped with a magnetic closure mechanism, the particular mechanism shown being composed of two magnet elements in the form of magnetic strips 33 and 34. These magnetic strips are capable of being independently moved in and out of their actuated positions by means of reciprocating motor assemblies 31 and 32. As shown, the magnetic strips 33 and 34 are arranged at spaced intervals from one another. The discharge opening 17 consisting of a flat channel may be of the same type which has already been described in connection with FIGS. 1 and 2 and is located at the bottom of the developing station. A further magnetic closure mechanism is situated in the region of the flat channel discharge opening 17, being composed of two magnetic elements in the form of magnet strips 37 and 38 which are separately movable into and out of outlet closing relationship by means of motors 35 and 36 which reciprocate the same as shown by the arrows. The strips 37 and 38 are likewise located at a spaced interval from one another.

The magnetic strips 33, 34, 37 and 38 are controlled by means of switches S1 and S2 which are under the control of a microprocessor-controlled control means MCU which operates in a standard fashion. The actuation of the pairs of magnet strips occurs such that the magnet strips 33 and 34 or 37 and 38 alternately lie against the corresponding discharge channels 29 or 17, respectively. For example, with respect to the feed of the developer mix in the region of the reservoir 28, the feed occurs by first moving away the first magnetic strip 33 in the flow direction of the developer mix, the developer mix thereby penetrating into the feeder channel 29. This developer mix dams up against the magnetic strip 34 which is located in its innermost position, closest to the channel 29. Subsequently, the first magnetic strip 33 is, in turn, moved into close proximity with the channel 29 and the second magnetic strip is moved in the opposite direction, away from the channel 29. The developer mix which has dammed up in the feeder channel 29 can thus fall into the mix container 30. A continuous dosed addition of fresh developer mix is possible by means of this type of feed.

Similarly, the developer mix is removed from the developing station by sequential operation of the magnet strips 37 and 38 whereby developer mix dammed up in the discharge opening 17 is periodically dropped into the air collector 21.

In accordance with the invention, a microprocessor-controlled control means MCU controls the admission and the discharge of developer mix to and from the developing station such that small amounts of the mix present in the developing station are removed by means of the magnetic strips 37 and 38 in relatively short time intervals and these quantities of mix are then replaced by equal quantities of new mix from the reservoir 28 by means of operation of the magnetic strips 33 and 34.

Depending on the discharged output quantity of the replacement and on the actuation time in which the quantity is replaced, there can be established a desirable, mean age condition for the developer mix. This mean age condition can be determined in terms of days by dividing the overall mix quantity with the replacement quantity used per day.

In order to monitor the intermittent changing of the mix in a more convenient manner, a sensor SN is arranged in the mix container 30. The sensor may take the form of a light barrier or a capacitive or inductive sensor, or an ultrasound sensor. The sensor is necessary because the amounts of mix admitted and discharged can never be set to be exactly identical in practice. Depending on the level of the developer mix in the mix container 30 sensed by the sensor SN, the microprocessor-controlled control unit MCU then controls the feed of the developer mix through the feeder channel 29 and the emptying of the developer mix by means of the flat channel 17 such that a uniform level is established in the mix container 30 of the developing station.

A uniformly good printing quality can be obtained on the basis of the mean age condition of the mix which remains constant after a certain time due to the continuous mix replacement. Some problems with developer mixes which occur in standard developing stations wherein the developer mix is replaced only after a certain useful life are eliminated since these problems arise usually in the last part of the useful life. Such problems include device contamination due to high toner concentration, increase in volume of the developer and the developer conveying problems connected therewith in the developing station. On the basis of the substantially continuous mix changing, it is possible to keep the toner concentration in the mix constant without requiring a special follow-up upon aging. The overall replacement of the developer and the down times of the apparatus connected therewith thus occur only at widely spaced time intervals.

When the reservoir region 28 serves as a replaceable reservoir, the replacement can take place during the printing operation. The overall developing station is reduced to a minimum volume because the great quantities of developer which would otherwise be necessary for longer maintenance intervals are eliminated.

With continuous changing of the mix, the toner consumption is controlled in accordance with criteria such as operating hours and toner consumption, such control being accomplished by the microprocessor-controlled control means MCU.

Thus, a fine control of the dosing of the developer mix whether at the feed station or at the emptying station becomes possible with the alternately drivable magnetic strips.

As set forth previously in connection with the embodiments of FIGS. 1 and 2, electromagnets which are alternately energized can also be provided instead of the movable magnetic strips 33, 34, 37 and 38.

It should be evident that various modifications can be made to the described embodiments without departing from the scope of the present invention.

I claim as my invention:

1. In a non-mechanical printer or copier device having a developing station containing a developer mix including magnetic components, the improvement which comprises:

means at the base of said device defining a channel-like discharge opening extending over the width of said developing station, a magnetic closing device in close proximity to said discharge opening, said magnetic closing device comprising a magnetic strip extending the full width of said discharge opening and being positioned to form a plug of developer mix in said discharge opening when said magnetic closing device is activated, and permitting discharge of said developer mix through said discharge opening when deactivated, means pivotally moving said magnetic strip toward and away from said discharge opening, a suction device downstream of said discharge opening for drawing the entire developer mix in said developing station through said discharge opening, means including said magnetic closing device for periodically withdrawing small quantities of developer mix at regular time intervals from said developing station, and means including a reservoir and a second magnetic closing device for introducing small quantities of fresh developer into said developing station at predetermined regular intervals, whereby the developer mix achieves a constant means age condition.

2. An apparatus according to claim 1 which includes a level sensor positioned to sense the level of developer mix in said developer station, and control means interconnecting said level sensor and said magnetic closing devices to control the introduction of developer mix into said developer station in response to variations sensed by said level sensor.

3. An apparatus according to claim 1 wherein each of said magnetic closing devices includes at least two separately actuatable magnetic elements in spaced relation to each other.

* * * * *